US008171741B2

(12) United States Patent
Hughes et al.

(10) Patent No.: US 8,171,741 B2
(45) Date of Patent: May 8, 2012

(54) ELECTRICALLY CONDUCTIVE SHIELD FOR REFRIGERATOR

(75) Inventors: Timothy John Hughes, New Milton, Hampshire (GB); Keith White, Abingdon, Oxfordshire (GB); Stephen Joseph Shelford Lister, Oxford, Oxfordshire (GB)

(73) Assignee: Siemens Plc, Frimley, Camberley (GB)

( * ) Notice: Subject to any disclaimer, the term of this patent is extended or adjusted under 35 U.S.C. 154(b) by 1088 days.

(21) Appl. No.: 11/597,655

(22) PCT Filed: Mar. 12, 2005

(86) PCT No.: PCT/EP2005/005153

§ 371 (c)(1),
(2), (4) Date: Feb. 15, 2008

(87) PCT Pub. No.: WO2005/117036

PCT Pub. Date: Dec. 8, 2005

(65) Prior Publication Data

US 2008/0250793 A1 Oct. 16, 2008

(30) Foreign Application Priority Data

May 25, 2004 (GB) ..... 0411603.4
Dec. 3, 2004 (GB) ..... 0426534.4

(51) Int. Cl.
*F25B 9/00* (2006.01)

(52) U.S. Cl. ..... 62/6; 62/45.1; 62/51.1

(58) Field of Classification Search ..... 62/6, 3.1, 62/45.1, 51.1; 6/6, 3.1, 45.1, 51.1; 335/216, 335/299, 300

See application file for complete search history.

(56) References Cited

U.S. PATENT DOCUMENTS

| | | | | |
|---|---|---|---|---|
| 3,956,648 | A | 5/1976 | Kirtley, Jr. et al. | |
| 5,461,873 | A * | 10/1995 | Longsworth | 62/51.1 |
| 5,584,184 | A * | 12/1996 | Inaguchi et al. | 62/6 |
| 5,701,744 | A | 12/1997 | Eckels et al. | |
| 5,918,470 | A * | 7/1999 | Xu et al. | 62/51.1 |
| 6,144,274 | A * | 11/2000 | Bischke et al. | 335/216 |
| 7,000,408 | B2 * | 2/2006 | Mitsubori | 62/6 |
| 7,127,901 | B2 * | 10/2006 | Dresens et al. | 62/77 |
| 2004/0106713 | A1 * | 6/2004 | Avakian | 524/404 |
| 2005/0166600 | A1 * | 8/2005 | Mitsubori | 62/6 |

FOREIGN PATENT DOCUMENTS

| | | |
|---|---|---|
| GB | 1 564 646 | 11/1977 |
| GB | 2 276 228 A | 9/1994 |
| GB | 2 331 798 A | 6/1999 |
| JP | 10-022118 A | 1/1998 |
| WO | WO 98/06972 | 2/1998 |

* cited by examiner

*Primary Examiner* — Mohammad Ali
(74) *Attorney, Agent, or Firm* — Crowell & Moring LLP

(57) ABSTRACT

A cryogenic magnet system, comprising a cryogenic vessel (1) housing a magnet winding, a vacuum jacket (3) enclosing the cryogenic vessel and a refrigerator (4) at least partially housed within the vacuum jacket and thermally linked (6) to the cryogenic vessel. In particular, the system further comprises an electromagnetic shield.

9 Claims, 3 Drawing Sheets

ELECTRICALLY CONDUCTIVE SHIELD FOR REFRIGERATOR

The present invention relates to cryogenic magnet apparatus for producing uniform magnetic fields. In particular, the present invention relates to a shield to be placed around a cryogenic refrigerator, to reduce the influence of the cryogenic refrigerator on the stability of the resultant magnetic field.

MRI magnet systems typically include cryogenic magnet apparatus and are used for medical diagnosis. A requirement of an MRI magnet is a stable, homogeneous, magnetic field. In order to achieve stability it is common to use a superconducting magnet system which operates at very low temperature, the temperature being maintained by cooling the superconductor, typically by immersion, in a low temperature cryogenic fluid, typically liquid helium. Cryogenic fluids, and particularly helium, are expensive, and it is desirable that the magnet system should be designed and operated in a manner to reduce to a minimum the amount of cryogenic liquid used.

The superconducting magnet system typically comprises a set of superconductor windings for producing a magnetic field, a cryogenic fluid vessel which contains the superconductor windings and the cryogenic fluid, one or more thermal shields completely surrounding the cryogenic fluid vessel, and a vacuum jacket completely enclosing the one or more thermal shields. In order to further reduce the heat load onto the fluid vessel, and thus the loss of liquid cryogen due to boil-off, it is common practice to use a refrigerator to cool the thermal shields to a low temperature. It is also known to use a refrigerator to directly refrigerate the cryogen vessel, thereby reducing the cryogen fluid consumption to zero. In both cases it is necessary to achieve good thermal contact between the refrigerator and the object to be cooled. Achieving good thermal contact at low temperature is difficult, and whilst adequate thermal contact can be achieved using pressed contacts at the thermal shield temperatures it becomes more difficult to achieve the desired thermal contact at very low temperature. The refrigerator needs to be removable for servicing, so the thermal contacts need to be removable which is difficult with pressed contacts. Condensation provides a good means of thermal contact so it is preferable to situate the vessel cooling part of the refrigerator within the cryogen gas if cryogen vessel refrigeration is needed. This means that the refrigerator is surrounded by the cryogen gas.

Any magnetic material in the vicinity of the magnet will be magnetized by the field surrounding the magnet, and its magnetism will affect the homogeneity and magnitude of the imaging field in the centre of the magnet. For materials which are stationary the disturbance can be compensated by a process known as shimming, in which extra fields are created in the imaging region which cancel the effect of the disturbing field. If there are moving magnetic materials in the vicinity of the magnet, shimming cannot compensate, and the imaging field is disturbed with a resulting degradation of the MRI image. It is evidently desirable to reduce such time varying interferences to a minimum. A Faraday cage around the magnet can shield it from high frequency interference, and a magnetically soft steel cage will ameliorate the effects of low frequency magnetic interference, outside the cages. But certain types of refrigerators which are used on superconducting MRI magnet systems may contain magnetic materials in their heat exchangers, known as regenerators, which move during the operation of the refrigerator. As these refrigerators are used to cool the MRI system, they are in close proximity to the magnet, and are usually situated partially inside the vacuum jacket of the magnet, and therefore cannot be shielded by the conventional means mentioned before. It is desirable to find a means of reducing the interference.

The refrigerator is subject to wear, and must be replaced after a certain time in order to maintain adequate performance. It must therefore be removably interfaced to the magnet system.

The moving magnetic materials of the refrigerator move in the field of the magnet, and the moving magnetization degrades the MRI image.

U.S. Pat. No. 5,701,744 describes a superconductive shield of bismuth alloy placed around a rare-earth displacement cryocooler. Such a shield has disadvantages in that the bismuth alloy shield may itself become permanently magnetised; the bismuth alloy used is relatively expensive, and does not have sufficient thermal conductivity. The shields described in U.S. Pat. No. 5,701,744 are provided with strips of highly thermally conductive material to help the sleeve reach its operating temperature.

The present invention accordingly provides apparatus as defined in the appended claims to address at least some of the disadvantages of the prior art.

The present invention provides an electrically conductive shield placed in the vacuum space surrounding that part of the refrigerator where moving magnetic parts are situated, so that magnetic field disturbances of the homogeneous field due to the moving magnetic parts of the refrigerator are reduced.

The above, and further, objects characteristics and advantages of the present invention will become more apparent from the following description of certain embodiments thereof, in conjunction with the accompanying drawings, wherein.

Figure 1:
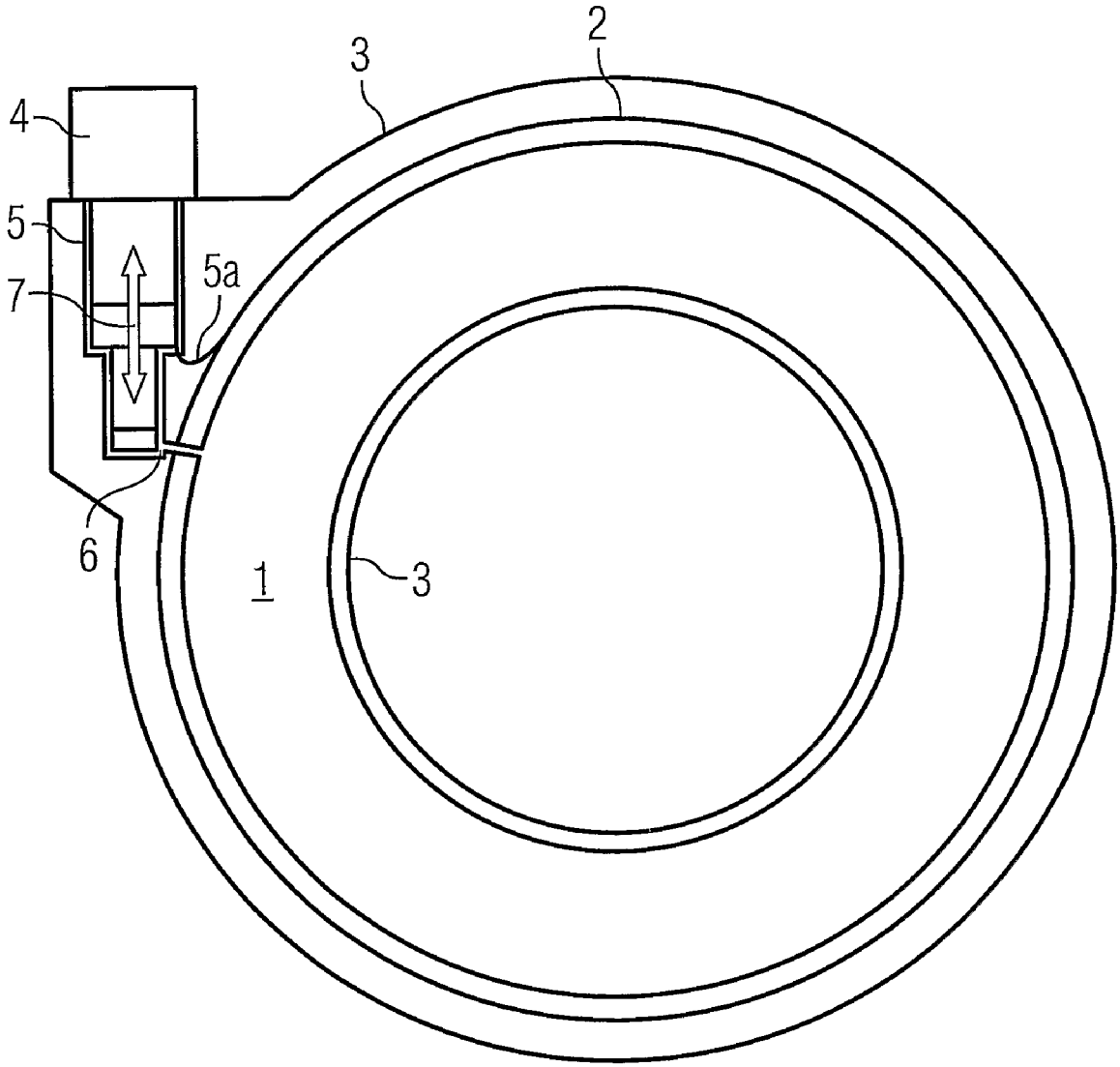
FIG. 1 shows a cross-section of a cryogenic magnet system which may benefit from the present invention.

FIG. 1 shows a schematic of a cryogenic magnet system fitted with a refrigerator 4 in an interface sock (also known as an interface sleeve) 5. The particular cryogenic magnet system illustrated is an MRI magnet system. Liquid cryogen vessel 1, containing superconductor magnet (not shown) is surrounded by one or more thermal shields 2, which are in turn completely surrounded by a vacuum jacket 3. Removably fitted to the magnet system is a refrigerator 4 thermally and mechanically interfaced by interface sock 5 so as to cool the thermal shields 2 through a thermal link 5*a*, which may be of braided copper or any other suitable known thermal link. Although not required by the present invention, the interior of the interface sock 5 may be in communion with the interior of the cryogen vessel 1, for example through a tube 6. The refrigerator 4 may then serve to recondense evaporated cryogen gas and deliver it back to the cryogen vessel 1 through the tube 6. During operation of the refrigerator, certain magnetic material may be brought into motion. For example, the regenerator material in a Gifford-McMahon (GM)-type refrigerator may oscillate as shown by arrow 7.

Figure 2:
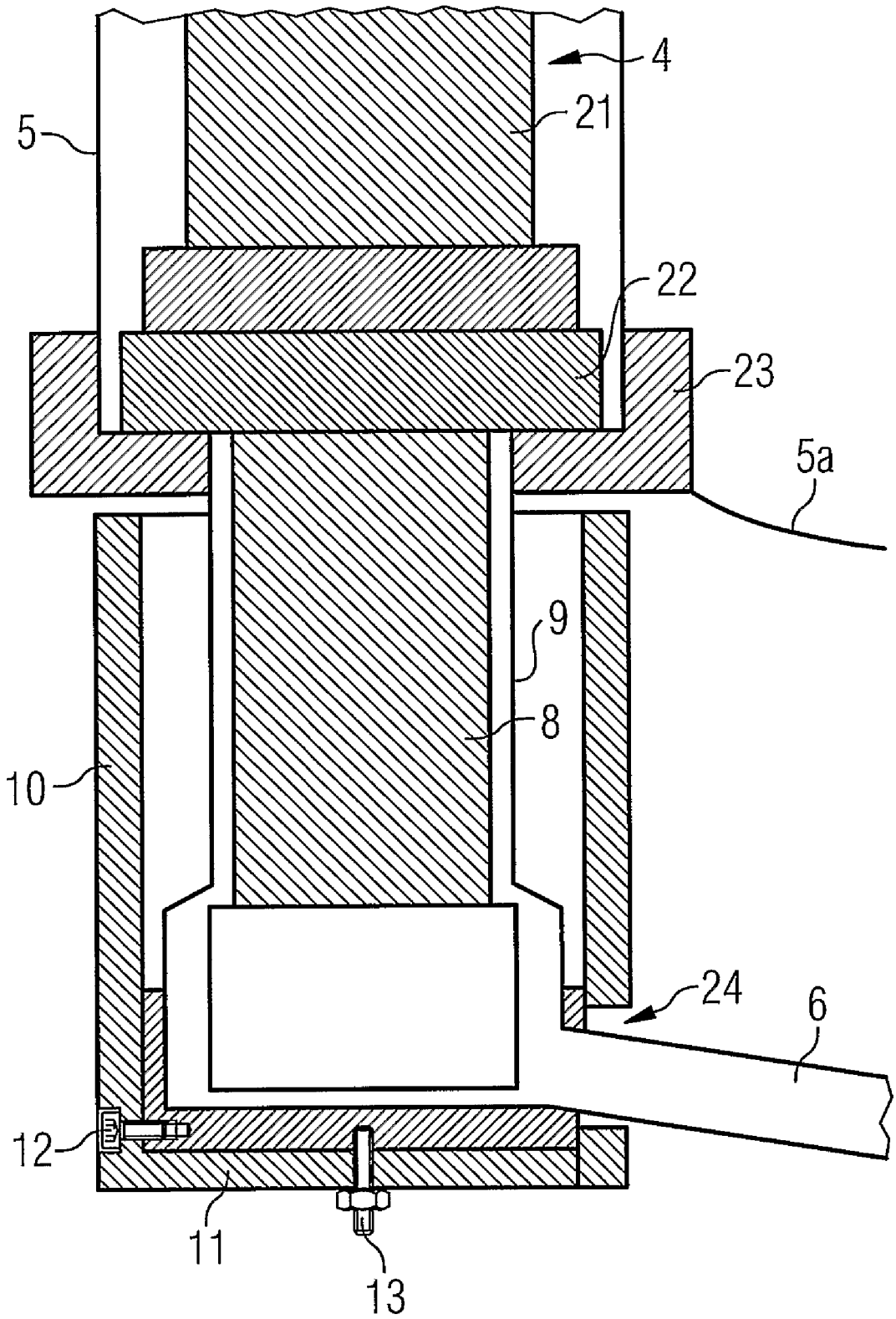
FIG. 2 shows part of a refrigerator and interface, suitable for use in a system such as that illustrated in FIG. 1, modified according to the present invention.

FIG. 2 shows an example of part of a refrigerator and interface sock in more detail. In the illustrated embodiment, the refrigerator is a two-stage refrigerator. A first stage 21 of the refrigerator 4 cools a first stage cooling stage 22, which is connected to a first stage thermal station 23 of the interface sock. This first stage thermal station 23 is thermally linked to the thermal shield(s) 2 by thermal link 5*a*, thereby, providing a heat path for the cooling of the shield(s) by the refrigerator. A second stage 8 of the refrigerator 4 is situated in the lower part 9 of the interface sock 5.

In the example of a two-stage Gifford-McMahon (GM)-type refrigerator, the regenerator of the second stage of the refrigerator may contain magnetic material. During operation of the refrigerator and the magnet, the second-stage regenerator material may move in the field generated by the magnet system. The movement of this material during operation of the refrigerator creates a disturbance in the magnetic field produced by the magnet system. This disturbance will then cause disruption of the uniformity of the magnetic field of the system, and disruption of images produced by an MRI system using the magnet. In systems other than MRI systems, otherwise undesirable disruptions to the homogeneity of the magnetic field will result.

According to an embodiment of the present invention, an electrically conductive shield 10 at least substantially surrounds the second stage 8 of the refrigerator 4, and is mechanically and thermally attached to the interface sock 5 near to the cold end 24. In the illustrated example, the body of the shield 10 is cylindrical, and is preferably closed at one end by a base 11 which is in good thermal contact with the body of the shield. In the illustrated example, the shield includes hole allowing tube 6 to protrude through the shield. The body of the shield 10 extends as far as possible along the refrigerator second stage 8 but not so as to touch the higher temperature regions of the refrigerator sock, such as the first stage thermal station 23. The shield 10 may be secured using screws 12 or studs and nuts 13 through, or around the periphery of, the base 11, or by other means to provide mechanical support and thermal contact between the shield 10 and the cold end 24 of the refrigerator interface sock 5.

In the illustrated embodiment, the refrigerator sock is filled with cryogen gas, and is in communion with the cryogen vessel 1. The shield 10 is located outside of the interface sock 5, in the vacuum between cryogen vessel 1 and vacuum jacket 3. Shield 10 is located within the vacuum space of the magnet system because it is typically a thermally conductive element as well as an electrically conductive element. If the shield 10 were placed inside the refrigerator interface sock, where there is cryogen gas in the illustrated example, the shield 10 would conduct heat by contact with the cryogen gas from near the upper regions of the second stage 8 of the refrigerator, which are at a temperature near that of the first stage heat stage 22, to the lower region of the second stage 8 of the refrigerator which are at a much lower temperature. This would seriously reduce the overall cooling ability of the refrigeration.

In alternative embodiments, the interface sock 5 may be sealed from the cryogen vessel 1, and the refrigerator may be in a vacuum space within the sock. In such embodiments, the shield 10 could also be placed inside the refrigerator interface sock, in close proximity to the second stage of the refrigerator.

Figure 3A:
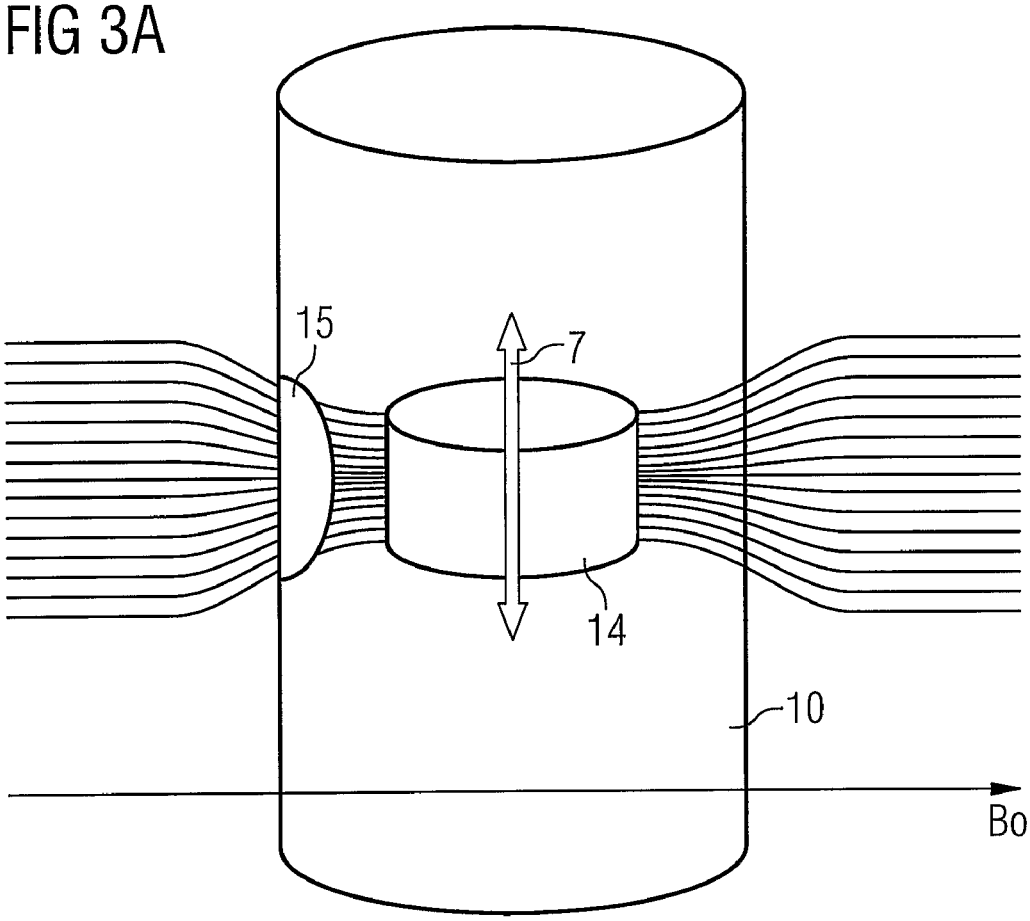
FIGS. 3A and 3B shows isometric and plan diagrams, respectively, useful for discussing the theoretical effects of the present invention.
Figure 3B:
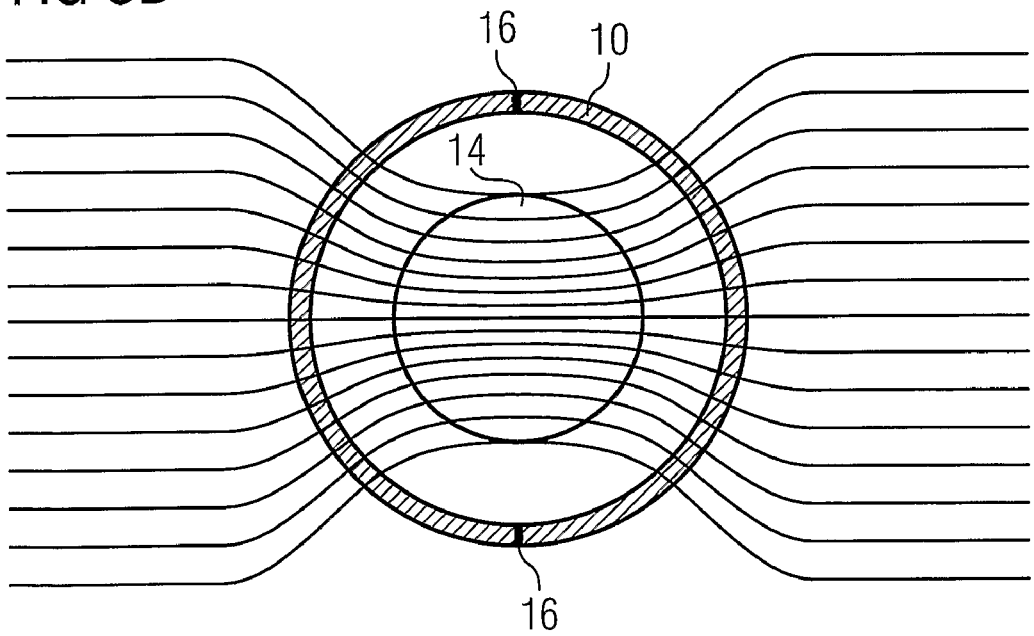

FIG. 3A-3B show the distortion of a field of the magnet system, modified according to an embodiment of the present invention, as a result of the presence and motion of magnetic material 14 such as within a regenerator of the refrigerator 4. Only the most distorted field lines are shown. The distortion is shown for a magnetic material 14 of a material which locally increases the magnetic field strength, but other types of magnetic material used in regenerators are of a type which decrease the local magnetic field strength. The present invention may be applied to embodiments in which either type of magnetic material is present.

The magnetic material 14 is within the electrically conductive shield 10 and produces a distortion of the local magnetic field. The field distortion intersects the wall of shield 10 in the area 15 indicated. Without wishing to be bound by any particular theory, the inventors believe that the following explanation gives an accurate understanding of the operation of the present invention. As the magnetic material moves during the operation of the refrigerator, as shown by arrow 7, the magnetic field distortion moves and the magnetic flux distribution intersecting the wall of the shield 10 changes. It is well known that if the magnetic flux intersecting a conductor changes, eddy currents are set up which oppose the change of flux. The overall effect of these eddy currents, which oppose changes in the magnetic flux, is that if the electrical conductivity of the shield 10 is large, the changes of magnetic field inside the shield 10 when the regenerator moves will be greatly reduced on the outside of the shield. The shield 10 accordingly reduces the effect of the moving magnetic material 14 on the magnetic field of the system.

The magnetic shielding effect of electrically conductive shields for cyclically time varying magnetic fields, such as that provided by the present invention, depends on the electrical resistivity ρ and thickness of the shield and the frequency f of the time variation. The "skin depth" δ at which the strength of the variation falls to 1/e of its value at the surface is $\delta=[\rho/\pi/\mu_0]^{0.5}$. The frequency f of the refrigerator is typically about 1-2 Hz. At room temperature the resistivity ρ of C101 copper is $17.9\times10^{-9}$ Ω-m, and of 1200 aluminium is $28.6\times10^{-9}$ Ω-m. The permeability of free space $\mu_0=4\pi\times10^{-7}$H/m. At room temperature and 2 Hz the skin depth is respectively 0.048 m and 0.060 m for copper and aluminium.

It is well known that the resistivity p of electrical conductors such as copper and aluminium decreases as the temperature is reduced; and that the reduction of resistivity increases as the purity and softness of the conductor increases. For carefully annealed aluminium of 99.9995% purity, the resistivity reduces by a factor of up to 5000 if the temperature is reduced to 4.2 K, and the skin depth at 2 Hz decreases to 0.85 mm. A shield of such aluminium 8 mm thick for example would reduce the field changes externally by a factor $e^{-9.4}=1/12{,}000$. To obtain the best shielding effect from shield 10 with a minimum thickness of material it is therefore important to ensure adequate thermal contact to the lowest temperature part 24 of the refrigerator interface sock 5, together with high purity material of the screen.

In practice it is expected that the shielding will not be as effective as calculated above, because of the finite length of the shield. It is to be understood that, although aluminium has been used as an example, other materials having similar electrical properties, for example copper, can also be used.

Referring to FIGS. 3A and 3B, the magnetic flux changes are in the areas indicated 15, aligned with the external field direction indicated by arrow Bo, and eddy currents will be set up in these regions. It is possible therefore with little effect on the shielding properties of the shield to cut shield 10 along its length, perpendicular to the field direction, as indicated at 16 in FIG. 3B. By providing the shield in two or more parts, assembly of the shield around the refrigerator interface sock 5 is made much more simple as compared to the process required for assembling a single piece shield around the refrigerator interface sock.

The invention claimed is:

1. A cryogenic magnet system, comprising:

a cryogenic vessel housing a magnet winding;

a vacuum jacket enclosing the cryogenic vessel; and a refrigerator at least partially housed within the vacuum jacket; wherein, the refrigerator comprises at least one cooling stage and a magnetic material that moves during operation of the refrigerator and is housed within a part of the refrigerator;

the system further comprises an electrically conductive shield that is thermally linked to a cooling stage of the refrigerator, and is arranged to substantially surround that part of the refrigerator which houses the magnetic material which moves; and the electrically conductive shield is formed by a matieral that is one of aluminum, copper, and another material having similar electrical and thermal properties.

2. The cryogenic magnet system according to claim 1, wherein the refrigerator is a two-stage refrigerator and the electrically conductive shield substantially surrounds the second stage of the refrigerator.

3. The cryogenic magnet system according to claim 1, wherein the refrigerator is a Gifford McMahon type refrigerator, and the magnetic material is a movable regenerator.

4. The cryogenic magnet system according to claim 3, wherein the refrigerator is a two-stage Gifford McMahon type refrigerator and the magnetic material is disposed in the second-stage of the refrigerator.

5. The cryogenic magnet system according to claim 1, wherein:

the refrigerator is housed within a refrigerator interface sleeve;

said interface sleeve is disposed substantially within a space between the cryogen vessel and the vacuum jacket; and the electrically conductive shield is placed on the outside of said interface shield sleeve.

6. The cryogenic magnet system according to claim 1, wherein the cooling part of the refrigerator is exposed to the interior of the cryogen vessel.

7. The cryogenic magnet system according to claim 1, wherein the shield material is of at least 99.999% purity.

8. The cryogenic magnet system according to claim 1, wherein the shield comprises at least two component parts assembled into place around the refrigerator.

9. A cryogenic magnet system, comprising:

a cryogenic vessel housing a magnet winding;

a vacuum jacket enclosing the cryogenic vessel; and a refrigerator at least partially housed within the vacuum jacket; wherein, the refrigerator comprises at least one cooling stage and a magnetic material that moves during operation of the refrigerator, and is housed within a part of the refrigerator;

the system further comprises an electrically conductive shield that is thermally linked to a cooling stage of the refrigerator, and is arranged to substantially surround that part of the refrigerator which houses the magnetic material which moves:

the electrically conductive shield comprises at least two component parts that are assembled into place around the refrigerator; and the at least two component parts are defined by a cut along an axial length of the shield, perpendicular to a field direction of said magnet winding.

* * * * *